US005603542A

United States Patent [19]

Walker

[11] Patent Number: 5,603,542

[45] Date of Patent: Feb. 18, 1997

[54] MANIPULATOR FOR ZIPPERS

[76] Inventor: Lorna Walker, 13 Iris Cir., Glen Rock, N.J. 07452

[21] Appl. No.: 507,612

[22] Filed: Jul. 27, 1995

[51] Int. Cl.[6] ..... A44B 19/24

[52] U.S. Cl. ..... 294/3.6

[58] Field of Search ..... 294/3.6, 15, 19.1, 294/26, 22; 24/381, 415, 429, 598.1–598.4, 600.4, 600.5, 601.6; 223/111

[56] References Cited

U.S. PATENT DOCUMENTS

| | | | |
|---|---|---|---|
| 1,209,615 | 12/1916 | Obsboum | 24/598.3 |
| 1,442,096 | 1/1923 | Robinson | 24/598.3 |
| 2,604,775 | 7/1952 | Le Blanc | 24/598.3 X |
| 2,811,763 | 11/1957 | Jordan | 294/3.6 |
| 2,928,157 | 3/1960 | Deering | 294/3.6 |
| 3,276,087 | 10/1966 | Hanson | 294/3.6 |
| 3,278,215 | 10/1966 | Zern | 294/3.6 |
| 3,348,870 | 10/1967 | Zern | 294/3.6 |
| 3,522,964 | 8/1970 | Posavec | 294/3.6 |
| 4,067,487 | 1/1978 | Carr et al. | 294/3.6 X |

FOREIGN PATENT DOCUMENTS

| | | | |
|---|---|---|---|
| 1435832 | 1/1969 | Germany | 294/3.6 |
| 796611 | 6/1958 | United Kingdom | 294/3.6 |

*Primary Examiner*—Johnny D. Cherry

[57] ABSTRACT

The disclosed device for manipulating zippers includes a handle, a prong for entry into the hole of a zipper's pull, or a hole in the slide of the zipper, if the pull is missing, and a spring for shifting the prong across a gap formed at one end of the handle, plus a manual actuator to retract the prong from the gap and thereby release the zipper's operator. One method of using the device includes affixing the prong of the zipper manipulator to the pull of a zipper that is attached to the rear of a garment, the garment being laid out or put-on back-to-front of the wearer, then moving the garment to its as-worn position with the zipper manipulator attached to it, operating the handle to close the zipper, and detaching the zipper manipulator from the zipper.

3 Claims, 3 Drawing Sheets

MANIPULATOR FOR ZIPPERS

The present invention provides a method and a device for facilitating the use of zippers, having particular utility in manipulating the slide of a zipper that is set in a garment, especially the back of a blouse or a dress. The invention is described in that application, but other uses are contemplated.

A common type of garment, notably a blouse or a dress, has a zipper at the back. The wearer puts on the garment with the zipper open, and then the wearer is expected to demonstrate remarkable dexterity in closing the zipper. A person whose mobility or dexterity is limited may call on another-person for help in closing the zipper. But if help is not available, and if the challenge of closing the zipper calls for greater mobility than the wearer of the garment possesses, a desperate situation has developed. One choice is for the wearer to put on the garment, leaving the zipper open in the hope of finding help, an obviously embarrassing choice. Another choice is for the wearer to discard a desired garment, substituting instead a garment that does not have a zipper at the back.

The present invention provides a method and a device for facilitating operation of a zipper. A manipulator for a zipper is provided that can be readily fastened to the zipper. In performing the novel method, a garment having an open zipper at the back may be laid out before being put on, or the wearer may put the garment on with the back of the garment at the front of the wearer. The zipper manipulating device is fastened to the zipper's slide. The garment is then put on or rearranged properly with its zipper at the back of the wearer, the manipulating device remaining fixed to the zipper. The manipulating device is used to close the zipper, and finally the manipulating device is detached.

The novel manipulating device comprises an elongated handle, one end of which is divided into first and second portions separated by a gap. A prong is slidably guided in the first portion between a retracted position and a projecting position crossing the gap and cooperating with the second portion of the bifurcated end of the handle. For enhanced performance, the second bifurcated portion of the handle has a recess that receives the end of the prong when in its projected position.

A spring contained in the handle acts on the prong to actuate it into its projected position. However, when the manipulating device is used in the method outlined above, the spring is not relied on to retain the prong in projected position, fixed to the zipper. Rather, the prong extends transverse to the gap; any force arising from the use of the manipulating device, i.e., a force acting in the direction tending to force the pull of a zipper out of the gap, is resisted by the attitude of the prong across the gap. The spring merely provides assurance of the manipulating device remaining in position fastened to the slide of a zipper once retention of the zipper by the prong has been established.

In the illustrative embodiment of the invention described in detail below, one manual actuator for the prong is located at or near the bifurcated end of the handle, readily accessible for manipulation for releasing the zipper. A second manual actuator of the prong is provided on the handle remote from the bifurcated end. Taking into account some limitation of a user's mobility and dexterity, provision of the two manual actuators of the manipulating device contributes significantly to success because one or the other of the manual actuators is always accessible to the user.

The elongated handle is proportioned for convenient storage in a purse. Its length is increased when necessary by providing a telescopic handle extension, or two extensions.

The novel zipper manipulating device meets a critical need in compensating for moderate limitations of a user's mobility. Even for persons whose mobility is not restricted, the device is useful in some circumstances.

A zipper depends for operation on a slide that must be drawn along the meshed row of teeth of the zipper in opposite directions to open the zipper and to close it. The zipper's slide is equipped with a pivotally attached pull. Commonly, the slide has a hole or holes that receive a pivot or pivots of the pull. A crisis develops when an article fitted with a zipper cannot be used because the slide has lost its pull. The manipulating device of the present invention can be used to open or close almost any zipper whose pull is missing; the prong of the novel manipulating device is receivable in the hole or holes of a zipper's slide in lieu of the lost pull of the zipper, to open and close the zipper.

In the case of some zippers that do not provide holes for the pull, the slide has grooves that receive pivots of the pull; with such zippers, when the pull is missing, the prong of the novel manipulating device can be projected into a groove of the slide for operating the zipper. Accordingly, the novel zipper manipulating device can be used in emergencies as a substitute for a pull that is missing from a zipper.

Additional applications will be found for the novel manipulating device for zippers. An illustrative embodiment of the novel zipper manipulator is shown in the accompanying drawings.

Figure 2:
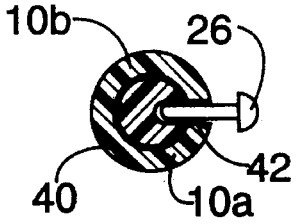
FIG. 2 is a cross-section of the embodiment of FIG. 1, at the plane 2—2 in FIG. 1.

In the drawings, an elongated handle 10 comprises parts 10*a* and 10*b* (see FIG. 2) which may be of molded plastic. Parts 10*a* and 10*b* are in all respects identical except that they are the mirror-images of each other.

Figure 1:
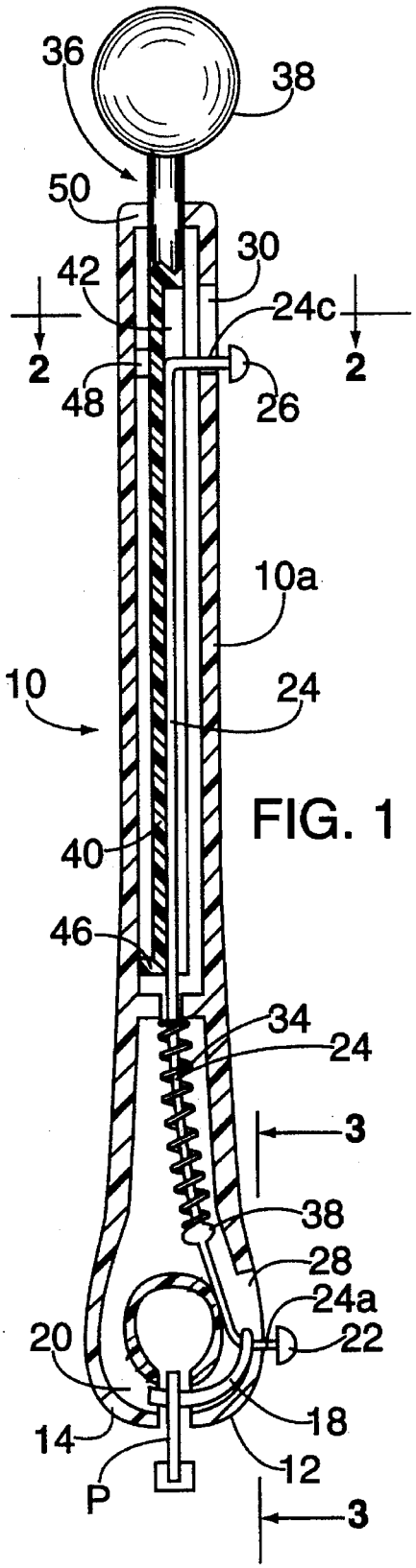
FIG. 1 is a lateral view of an illustrative embodiment of a zipper actuating device, one-half of its two-part handle being removed to reveal its internal structure, and one element being shown in cross-section, further including a zipper's pull in phantom.
Figure 6:
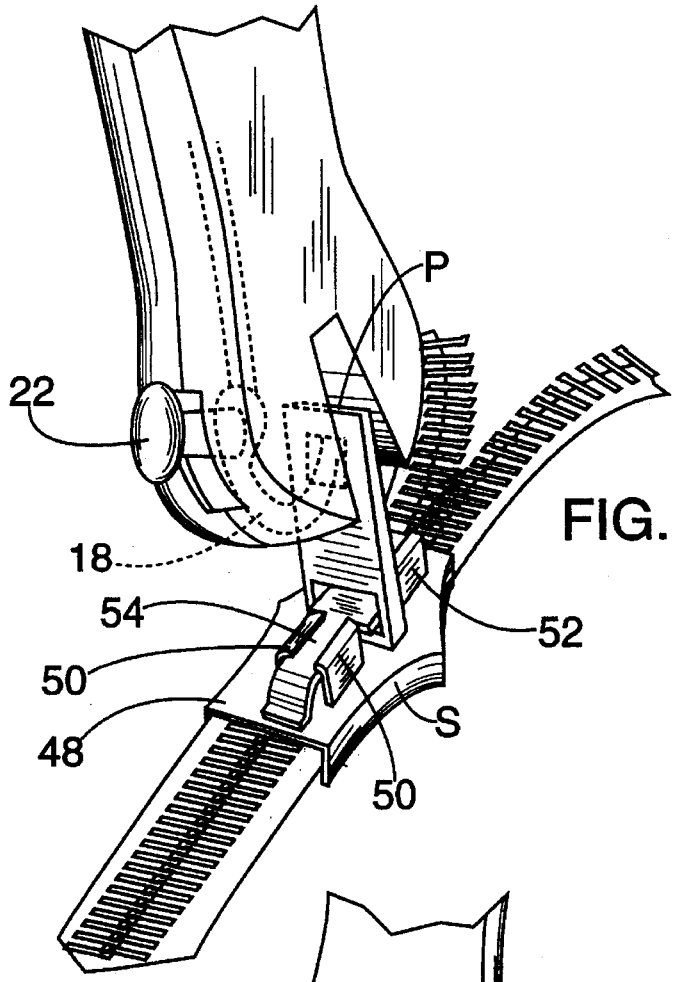
FIGS. 6 and 7 are enlarged perspective views of the manipulating device of FIGS. 1–4 in alternative relationships to a zipper.

The lower end of the handle is bifurcated so as to have a first portion 12 and a second portion 14 separated from each other by a gap 16. In FIG. 1, pull P of a zipper is disposed in gap 16. A prong 18 is operable between a retracted position (see FIG. 4) that leaves gap 16 free to receive the pull P of a zipper and a projecting position (FIG. 1). When the pull P of a zipper is in gap 16 and when prong 18 is in its projecting position, the prong extends through a hole in the zipper's pull (FIGS. 1 and 6). The prong enters a recess 20 (FIG. 1) in the second portion 14 of the bifurcated handle. The first bifurcated portion 12 of the handle provides an arcuate guide passage for the prong; the handle sheaths all of the prong when in its retracted position, and when the prong is in its projecting position, the handle sheaths all of the prong except that portion which extends across slot 16 and enters recess 20.

Figure 3:
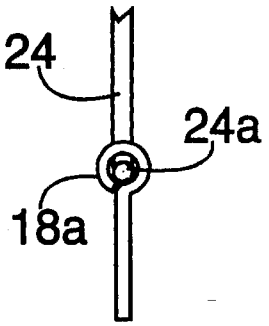
FIG. 3 is a fragmentary view of internal parts of the embodiment of FIG. 1, as seen from the plane 3—3 in FIG. 1.

A stiff wire or elongated rod 24 is slidable lengthwise in handle 10. The wire is bent to establish a wire portion 24*a* that extends outside the handle via slot 28 of the handle. Wire 24, 24*a* extends through an eye 18*a* in prong 18 (FIG. 3). A knob 22 is either an integral portion of wire portion 24*a*, or the knob is fastened to portion 24*a*. Knob 22 and wire portion 24*a* form a manual actuator connected to prong 18. A second knob 26, on or integral with portion 24*c* of the wire, extends outside the handle via slot 30 at a position remote from manual actuator 22, 24*a*. Knob 26, wire portion 24*c* and wire 24 constitute a second manual actuator of prong 18.

A compression coil spring 34, contained in handle 10, surrounds a portion of wire 24. The ends of this spring are confined between a barrier portion 36 of the handle and an abutment 38 that is an integral swaged or upset portion of wire 24.

Figure 4:
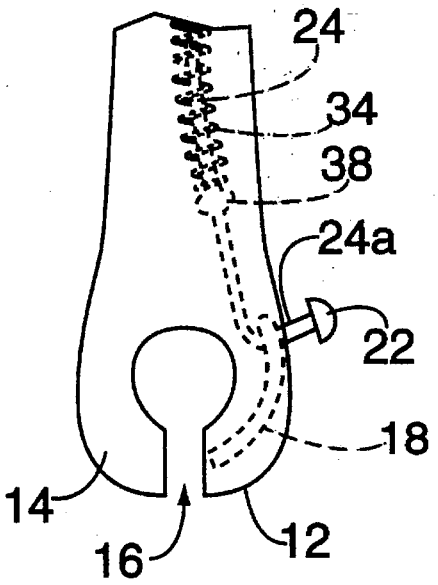
FIG. 4 is a fragmentary lateral view of the embodiment in FIG. 1, with internal parts in a position that differs from FIG. 1.

In FIG. 4, the prong is shown in its retracted position, and spring 34 is compressed. This is the condition that is developed by operating either manual actuator 22, 24*a* or 26, 24*c*, 24 to retract the prong. Gap 16 is then cleared to admit the pull of a zipper. When the prong has been retracted (FIG. 4) and a pull of a zipper is placed in gap 16, releasing the actuated knob 22 or 26 frees the compressed spring to shift the prong across slot 16 and through the hole of an interposed zipper's pull. (FIG. 1 and FIG. 6.)

Quite apart from spring 24, the arrangement of the prong transverse to the zipper's pull provides stable retention of the pull. Force applied to the handle does not develop any tendency for the pull to escape from the prong. There is no need for the spring to provide significant force to prevent escape of the pull from the prong. The retention of the pull by the prong is enhanced by virtue of the entry of the prong's tip into recess 20.

Figure 5:
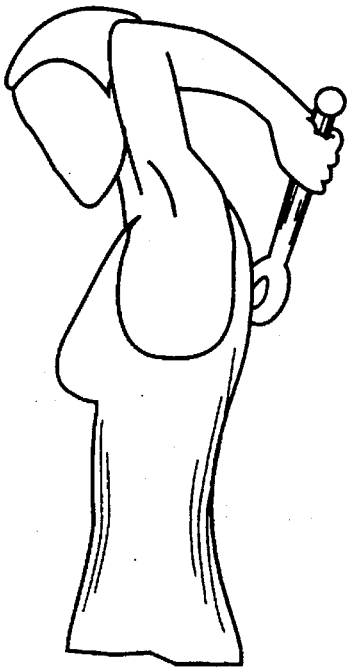
FIG. 5 shows one manner of using the novel zipper manipulator of FIGS. 1–4.

The described manipulator for a zipper's pull is used in the following manner. With the garment laid out for use or with the garment put on backward (with the zipper at the front) prong 18 is retracted so that gap 16 is free to receive the zipper's pull (FIGS. 4 and 5). Release of the manual actuator 22, 24*a* or the actuator 26, 24*a*, 24 allows spring 34 to project the prong through the hole in the zipper's pull. When the prong is in its projected position, spring 34 is still in compression. The garment is then put on properly, with the manipulator fixed to the zipper and the zipper disposed at the wearer's back. Using the manipulator, the zipper is then closed by drawing the slide S up the wearer's back. This is readily performed by persons whose mobility is moderately restricted. Finally, the prong 18 is retracted and the manipulator is removed.

Spring 34 greatly facilitates the described manner of using the novel zipper manipulator. However, even in the absence of the spring, the manual actuators 22, 24*a* and 26, 24*c*, 24 may be used to drive prong 18 to its projecting position, to establish retentive engagement of prong 18 with the zipper's pull. Some inherent friction may be relied on, or deliberately enhanced friction may be provided, for retaining the prong in its projected position. However, the spring greatly enhances the performance of the device.

Handle 10 is of substantial length; for example, it is six or seven inches long. This is adequate for nearly all persons and all garments. However, the length of the zipper manipulator can be increased, as may sometimes be necessary, by utilizing handle extension 36. This extension comprises a knob 38 and a rod 40 that is received telescopically in the handle, retracted, when it is not needed. Rod 40 has a longitudinal groove 42 along most of its length, providing space for wire 24. An enlargement 46 of rod 40 coacts with stop 48 in handle 10 to prevent the extension from being removed entirely from the handle. Stop 48 is spaced somewhat from a rod guide 50 to maintain alignment of the extension and the handle, enabling the user, grasping the extension, to control the handle. Using telescopic rod 20 for increasing the length of the handle will be useful to some individuals whose arm mobility may be very limited, or for dealing with unusual conditions. When the zipper is closed fully, the telescopic rod may be telescoped into the handle, and the prong may then be released from the zipper by manipulating the more accessible knob 22 or 26.

The zipper manipulator described above and shown in the drawings may be used in other circumstances, and modifications may be introduced. For example, rod 40 may be replaced by a doubly telescopic extension of the handle.

FIG. 6 shows the novel zipper manipulator in condition to be retentively engaged with a pull P of a typical zipper. Prong 18 is retracted into the handle; release of knob 22 allows prong 18 to project through a hole in pull P. The zipper includes a slide S, which is operated by pull 18. The zipper manipulator is moved upward to the right in the drawing to close the zipper and it is moved downward and to the left to open the zipper. Slide S in the form shown includes a body 48 having upstanding pairs of walls 50 and 52. The walls of each pair are spaced apart and there is a gap between walls 50 and 52. A cover strip 54 is locked between the pairs of walls 50 and 52. Pull P has turned-in pivots in the gap between the pair of walls 50 and the pair of walls 52. Slide S is hollow between the pair of walls 50 and 52 and below cover strip 54. The gap between the pair of walls 50 and the pair of walls 52 forms a passage 56 (FIG. 7) under cover strip 54. The slide of zippers typically has a transverse passage 56.

Figure 7:
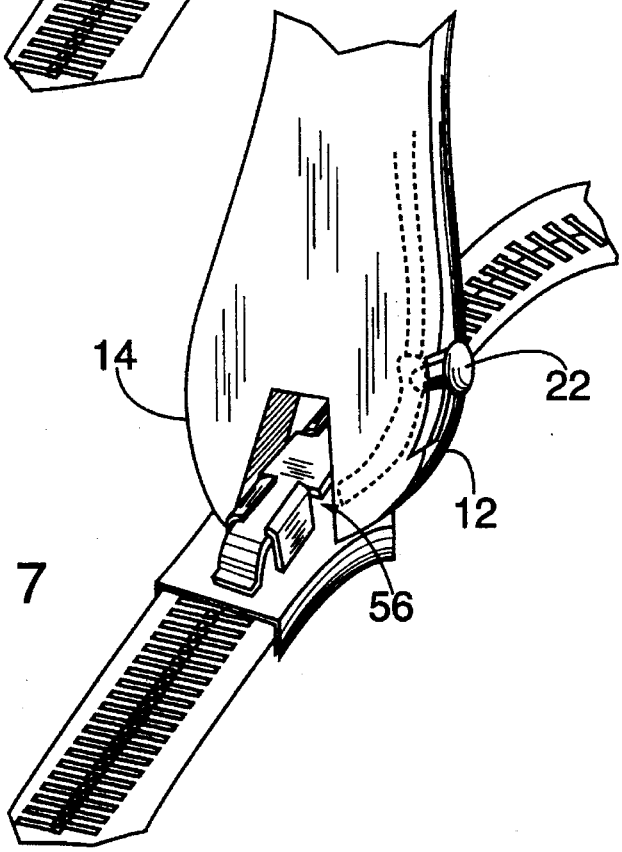

The pull P is missing from the slide in FIG. 7. When the pull is missing from the slide of any zipper, it is very difficult to operate the slide.

The zipper manipulator of FIGS. 1–4 can be used to operate a typical slide whose pull P is missing. FIG. 7 shows the zipper manipulator of FIGS. 1–4 in a preliminary position for establishing retentive engagement with the zipper's slide. Prong 18 is retracted from gap 16 of the zipper manipulator and bifurcated portions 12 and 14 straddle the slide of the zipper. Releasing knob 22 allows the sheathed prong 18 to extend through passage 56, establishing retentive engagement between the zipper's slide and the zipper manipulator. It is then easy to operate the zipper even though its pull is missing.

Various modifications may be introduced into the device of FIGS. 1–4, as desired; consequently, the invention should be construed broadly in accordance with its true spirit and scope.

I claim:

1. A zipper manipulating device including an elongated handle having a bifurcated end including first and second portions separated by a gap for receiving an operating element of a zipper, a prong operable from a retracted position sheathed in said first portion of the handle to a projecting position wherein a portion of the prong projects across said gap, said prong in said projecting position extending through a hole in an operating element of the zipper when in retentive engagement therewith, said handle containing a spring for operating said prong into said projecting position, and a manual actuator for said prong having a connection to said prong and projecting outside the handle for manipulating the prong into its retracted position wherein the prong is disengaged from the operating element in said gap, said manual actuator being disposed near said bifurcated end of the elongated handle, further including a second manual actuator projecting outside of the handle remote from the bifurcated end of the handle and having a connection inside the handle to said prong for manipulating the prong into its retracted position and thereby releasing the prong's retentive engagement with any element of a zipper that may be disposed in said gap and freeing the gap for insertion of an operating element of a zipper.

2. A zipper manipulating device as in claim 1, wherein said handle has at least one telescopic extension.

3. A zipper manipulator including an elongated handle having at one end thereof an abutment against which a zipper-operating element may be disposed, a prong carried by the handle, said prong being operable between a retracted position and a projecting position in cooperation with said abutment, and said prong being proportioned to enter a hole in a zipper-operating element when disposed opposite to said abutment in a manner to establish retentive engagement of the prong with said element, said handle having means tending to retain said prong in said projecting position when disposed in that position, a manual actuator connected to said prong for retracting the prong away from said abutment and thereby releasing any element of a zipper that may be retentively engaged by the prong, said manual actuator projecting from said handle near said one end thereof, further including a second manual actuator connected to said prong and projecting from said handle at a point remote from said one end of the handle.

* * * * *